US010508483B2

(12) United States Patent
Dubach

(10) Patent No.: US 10,508,483 B2
(45) Date of Patent: Dec. 17, 2019

(54) EJECTION DEVICE FOR A MOVABLE FURNITURE PART

(71) Applicant: Julius Blum GmbH, Hoechst (AT)

(72) Inventor: Fredi Dubach, Baeretwil (CH)

(73) Assignee: Julius Blum GmbH, Hoechst (AT)

( * ) Notice: Subject to any disclaimer, the term of this patent is extended or adjusted under 35 U.S.C. 154(b) by 46 days.

(21) Appl. No.: 15/830,550

(22) Filed: Dec. 4, 2017

(65) Prior Publication Data

US 2018/0087305 A1 Mar. 29, 2018

Related U.S. Application Data

(63) Continuation of application No. PCT/AT2016/050143, filed on May 17, 2016.

(30) Foreign Application Priority Data

Jun. 9, 2015 (AT) ..... A 361/2015

(51) Int. Cl.
*E05F 1/10* (2006.01)
*A47B 88/04* (2006.01)
(Continued)

(52) U.S. Cl.
CPC ..... *E05F 1/08* (2013.01); *A47B 88/463* (2017.01); *E05F 1/10* (2013.01); *E05F 1/1041* (2013.01);
(Continued)

(58) Field of Classification Search
CPC ..... E05F 1/08; E05F 1/10; E05F 1/105; E05F 1/16; E05F 1/1041; A47B 88/46; A47B 88/463; A47B 88/47
See application file for complete search history.

(56) References Cited

U.S. PATENT DOCUMENTS 8,282,175 B2 10/2012 Herper et al.
9,771,750 B2 9/2017 Held
(Continued)

FOREIGN PATENT DOCUMENTS

AT 008 629 10/2006
CN 101680260 3/2010
(Continued)

OTHER PUBLICATIONS

Austrian Search Report dated Aug. 3, 2018 in Patent Application No. GM 8025/2016, with English Translation.
(Continued)

*Primary Examiner* — Kimberley S Wright
(74) *Attorney, Agent, or Firm* — Wenderoth, Lind & Ponack, L.L.P.

(57) ABSTRACT

An ejection device includes a support formed as a housing; an ejection element for ejecting the movable furniture part from a closed position into an open position along an ejection path; an ejection force accumulator which applies a force to the ejection element in the opening direction of the movable furniture part; and a clamping device for clamping the ejection force accumulator. The clamping device has a clamping element to be coupled to the movable furniture part, and a movement transmission element, in particular a rotatable movement transmission element, between the clamping element and the ejection element. The clamping element and the ejection element can be moved in opposite directions when coupled by the movement transmission element when the ejection force accumulator is clamped, and the ejection element, the movement transmission element, and the clamping element are moveable together relative to the support over a first part of the ejection path.

22 Claims, 14 Drawing Sheets

(51) Int. Cl.

| | |
|---|---|
| ***E05C 19/16*** | (2006.01) |
| ***E05F 1/08*** | (2006.01) |
| ***A47B 88/463*** | (2017.01) |
| *E05F 1/16* | (2006.01) |

(52) U.S. Cl.
CPC ..... *E05F 1/16* (2013.01); *E05Y 2201/426* (2013.01); *E05Y 2201/716* (2013.01); *E05Y 2201/722* (2013.01); *E05Y 2600/502* (2013.01); *E05Y 2900/20* (2013.01)

(56) References Cited

U.S. PATENT DOCUMENTS

| | | | | |
|---|---|---|---|---|
| 9,803,411 | B2 * | 10/2017 | Grabher | E05F 15/00 |
| 9,968,192 | B2 * | 5/2018 | Albrecht | E05F 15/00 |
| 10,405,653 | B2 * | 9/2019 | Goetz | A47B 88/447 |
| 2004/0055221 | A1 * | 3/2004 | Hoffman | E05F 1/105 49/386 |
| 2008/0048538 | A1 * | 2/2008 | Karg | E05F 1/1066 312/319.2 |
| 2011/0131884 | A1 | 6/2011 | Herper et al. | |
| 2013/0140970 | A1 * | 6/2013 | Dubach | F03G 1/00 312/319.1 |
| 2013/0180081 | A1 | 7/2013 | Salice | |
| 2014/0319986 | A1 * | 10/2014 | Brunnmayr | A47B 88/57 312/319.1 |
| 2015/0091427 | A1 * | 4/2015 | Haemmerle | A47B 88/40 312/333 |
| 2015/0374123 | A1 * | 12/2015 | Goetz | E05B 65/462 312/319.1 |
| 2015/0374125 | A1 * | 12/2015 | Goetz | A47B 88/463 312/319.1 |
| 2016/0186476 | A1 | 6/2016 | Held | |
| 2016/0206093 | A1 * | 7/2016 | Brunnmayr | A47B 88/483 |
| 2016/0242542 | A1 * | 8/2016 | Friesenecker | E05F 15/63 |
| 2017/0051813 | A1 * | 2/2017 | Karu | E05F 1/16 |
| 2018/0094457 | A1 * | 4/2018 | Hammerer | E05F 1/10 |
| 2018/0100329 | A1 * | 4/2018 | Hammerer | E05C 19/022 |
| 2018/0155972 | A1 | 6/2018 | Filges | |

FOREIGN PATENT DOCUMENTS

| | | |
|---|---|---|
| CN | 103742018 | 4/2014 |
| DE | 20 2006 013 028 | 2/2008 |
| DE | 10 2010 031 940 | 3/2011 |
| DE | 21 2013 000 081 | 11/2014 |
| EP | 3 289 155 | 3/2018 |
| WO | 2008/022673 | 2/2008 |
| WO | 2012/100981 | 8/2012 |
| WO | 2013017666 | 2/2013 |
| WO | 2013/134798 | 9/2013 |
| WO | 2013/134799 | 9/2013 |
| WO | 2016/174026 | 11/2016 |

OTHER PUBLICATIONS

International Search Report dated Aug. 19, 2016 in International (PCT) Application No. PCT/AT2016/050143.

Search Report dated Mar. 14, 2016 in Austrian Application No. A 361/2015, with English translation.

* cited by examiner

SS + VS + EK

US

US+ES+EK

OS + ES + K

OS + ES + K

OS + ES + EK

EJECTION DEVICE FOR A MOVABLE FURNITURE PART

BACKGROUND OF THE INVENTION

The invention concerns an ejection device for a movable furniture part. The ejection device includes a carrier, in particular formed as a housing, an ejection element for ejecting the movable furniture part from a closed position into an open position (along an ejection path, and an ejection force storage member force-actuating the ejection element in the opening direction of the movable furniture part. The ejection force storage member on the one hand engages the carrier and on the other hand engages the ejection element. A tensioning device is provided for tensioning the ejection force storage member, and the tensioning device includes a tensioning element which can be coupled to the movable furniture part, and a rotatable movement transmission element between the tensioning element and the ejection element. The tensioning element and the ejection element can be moved in opposite directions in a coupled manner by the movement transmission element when the ejection force storage member is tensioned. Moreover, the invention concerns an item of furniture with a furniture carcass, a movable furniture part, and an ejection device for the movable furniture part.

For many years, ejection devices for movable furniture such as drawers, furniture doors, or furniture flaps have been known in the industrial sector of furniture fittings. Such ejection devices are also often referred to as touch-latch-mechanisms or as tip-on-mechanisms.

An example of such an ejection device is disclosed in WO 2013/134798 A1 of the applicant. In the last embodiment of this document, a tensioning device for tensioning the ejection force storage member is provided, and the tensioning element is pulled via a magnet by the movable furniture when opening. This movement of the tensioning element in the opening direction is converted into a movement of the ejection element in the opposite direction by a movement transmission element in the form of a gear wheel. As a consequence, the ejection force storage member is loaded by the tensioning device when pulling the movable furniture part. In this ejection device, the rotatable movement transmission element always remains on the same position, whereby—in order to load ejection force storage member—relative large paths have to be travelled by the tensioning element.

The object of the present invention, thus, is to provide an alternative or improved ejection device compared to the prior art.

SUMMARY OF THE INVENTION

The above object is achieved by providing an ejection device in which the ejection element, the movement transmission element, and the tensioning element can be moved together relative to the carrier at least over a first part of the ejection path. Thus, a part of the movement path to be carried out during the tensioning movement can already be travelled in common by these three components. No decoupling between these three components has to be carried out, too. In addition, two elements, namely the ejection element and the tensioning element, do not have to project from the carrier or from the housing of the ejection device as is the case in the prior art.

It is basically possible that the common movement of the movement transmission element, the tensioning element, and the ejection element is only relatively short or is carried out only over a part of the ejection path of the ejection element. Preferably, however, the ejection element, the movement transmission element, and the tensioning element can be moved together relative to the carrier over the whole ejection path.

For a simple possibility of the common movement, preferably the ejection element, the movement transmission element, and the tensioning element are, preferably linearly, displaceable together along a guide track formed in the carrier and comprising two end abutments. In order to carry out the tensioning of the ejection force storage member as exactly as possible, preferably the movement transmission element abuts an end abutment of the guide track when the ejection force storage member is tensioned.

Basically, it is possible that the movement transmission element is, for example, constructed in the form of a lever mechanism or in another manner. For a simpler and safer construction, preferably the movement transmission element is formed as a gear wheel. Suitable for this embodiment, in a preferred manner, the tensioning element and the ejection element each comprise a gear rack. Thus, preferably, when the ejection force storage member is tensioned, the gear rack of the tensioning element and the gear rack of the ejection element mesh with the movement transmission element formed as a gear wheel and are movable, preferably in the form of a 1:1-transmission ratio, in opposite directions in a coupled manner by the movement transmission element. Therefore, a secure transmission of the tensioning movement to the ejection force storage member is guaranteed.

In order to guarantee that, after the tensioning of the ejection force storage member, the tensioning element is not projecting from the furniture carcass until the movable furniture part is closed again, preferably a retrieving device for moving the tensioning element in a retrieved position is provided. The retrieving device comprises a retrieving element, which can be coupled to the tensioning element, and a retrieving force storage member force-actuating the retrieving element. In principle, this retrieving device can be formed separately from the rest of the ejection device. In order to use as few components as possible, however, it is preferable that the retrieving element is integrally formed with the movement transmission element. Thus, this movement transmission element has a double function, namely when tensioning the ejection force storage member and when retrieving the tensioning element. For that purpose, it is particularly preferred that the retrieving element comprises a slider, and the movement transmission element is formed as a gear wheel and is rotatably supported in the slider. In the case of this compact construction, in the same manner as with the tensioning device, the retrieving element is displaceably supported in a limited manner in the guide track comprising two end abutments and formed in the carrier.

For the general function of the ejection device, it shall not be excluded that the ejection force storage member is tensioned by the tensioning device when closing the movable furniture part. In order to use the active additional opening movement anyhow mostly carried out after the ejection by a user, it is preferable that the ejection force storage member can be tensioned by the tensioning device when pulling the movable furniture part in the opening direction, preferably along a tensioning path subsequent to the ejection path.

In order to prevent an undesired triggering of the ejection device, a locking device for locking the ejection element in a locking position is provided, and the locking device can be unlocked by over-pressing the movable furniture part into an over-pressed position located behind the closed position. In this case, the locking can be effected, for example, on the basis of the ballpoint-pen-principle, by friction surfaces, or by similar variants. Preferably, the locking device comprises a, preferably cardioid-shaped, sliding guide track formed in the carrier, a control lever movably, preferably rotatably, supported on the ejection element, and a control pin arranged on the control lever and engaging the sliding guide track.

Furthermore, an item of furniture has a furniture carcass, a movable furniture part, and an ejection device according to the invention for moving the movable furniture part. In this case, it is irrelevant whether the ejection device itself is arranged on the movable furniture part and is repelling from the furniture carcass, or whether the ejection device is arranged on the furniture carcass and actively ejects the movable furniture part into the opening direction. The basic function principle remains the same for both variants. Such an ejection device can be preferably combined with a, preferably damped, retraction device too. Thus, not only a simple ejection by pressing onto the movable furniture part is possible, but the movable furniture part is also actively retracted in a closing direction on the last centimeters or millimeter of the closing path. For example, such a retraction device can be integrated in a hinge of a furniture door. The ejection device and the retraction device can be—but do not have to be—integrated in one construction unit.

BRIEF DESCRIPTION OF THE DRAWINGS

Further details and advantages of the present invention are described more fully hereinafter by means of the specific description with reference to the embodiments illustrated in the drawings, in which.

DETAILED DESCRIPTION OF THE INVENTION

Figure 1A:
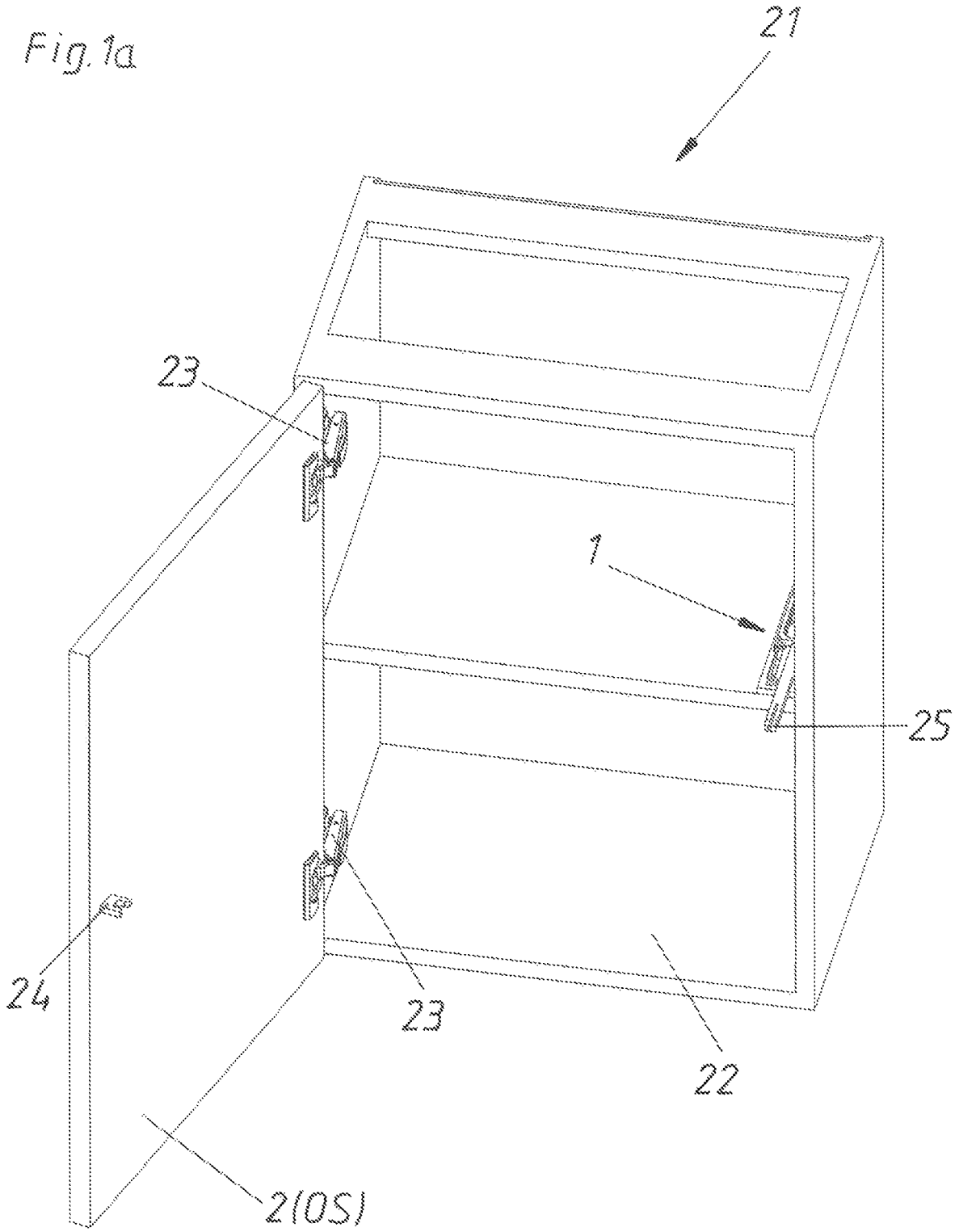
FIG. 1*a* is a perspective view of an item of furniture with a furniture door and an ejection device.

FIG. 1 a shows an item of furniture 21 with a furniture carcass 22 and a movable furniture part 2 in the form of a furniture door. The movable furniture part is pivotally supported on the furniture carcass 22 by two hinges 23. A retracting device (not shown) for the movable furniture part 2 can be integrated in one of these hinges 23. An ejection device 1 is arranged on the furniture carcass 22 on a position remote from the hinges 23. In this case, it can be seen that the ejection device 1 comprises a coupling piece 25 on an end facing towards the movable furniture part 2. This coupling piece 25 can be coupled with a coupling counter piece 24 arranged on the movable furniture part 2. In this FIG. 1*a*, the movable furniture part 2 is an open position OS.

Figure 1B:
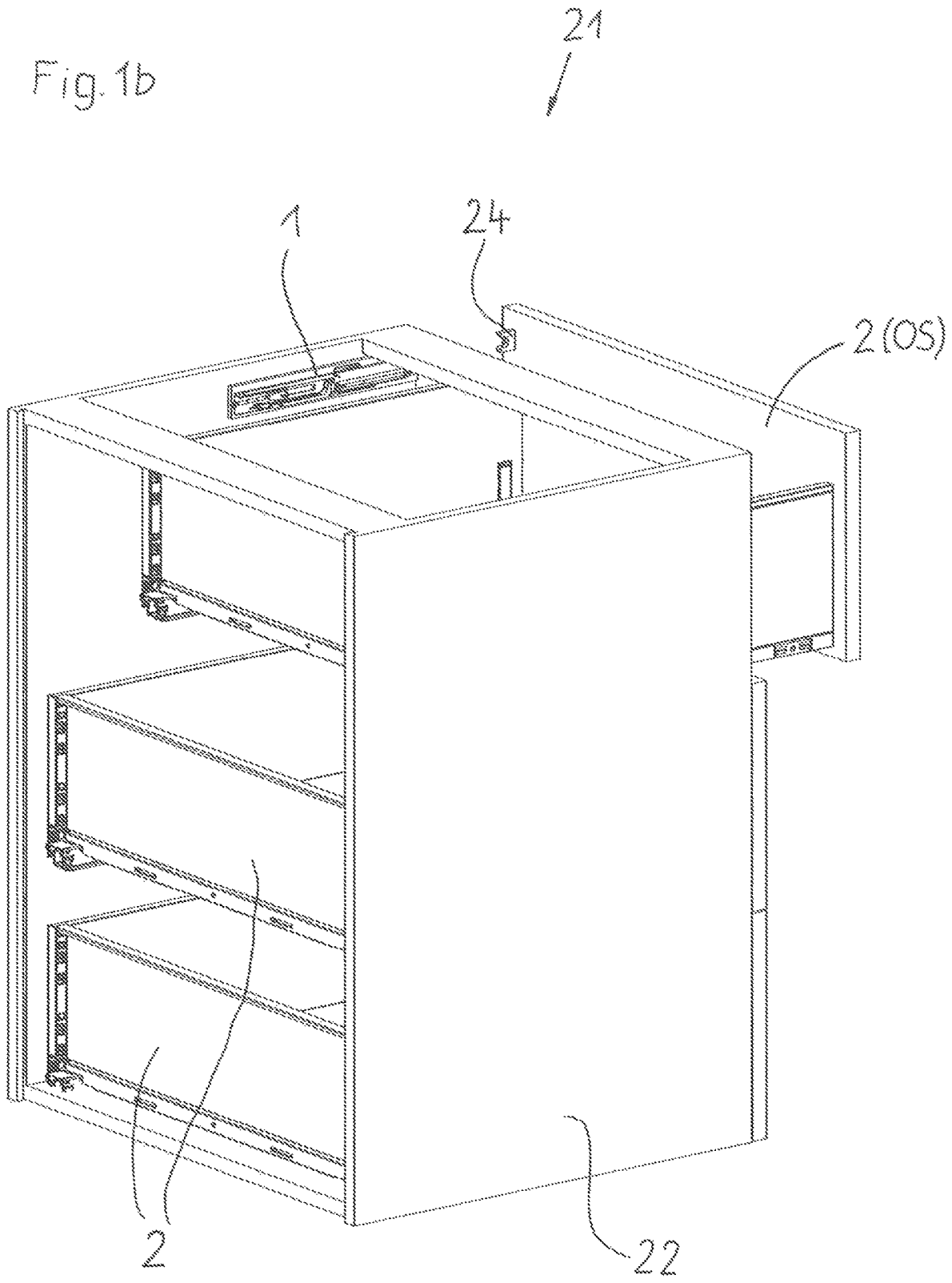
FIG. 1*b* is a perspective view of an item of furniture with three drawers and an ejection device each.

FIG. 1*b* shows an item of furniture 21 with a furniture carcass 22 and three movable furniture parts 2 in the form of drawers. The drawers are displaceably supported on the furniture carcass 22 by drawer extension guides. An ejection device 1 for ejecting the drawers into an open position OS (see top drawer) is arranged on the furniture carcass 22. The ejection device 1 can also be arranged on the drawer itself or on a rail of the extension guide.

Figure 2:
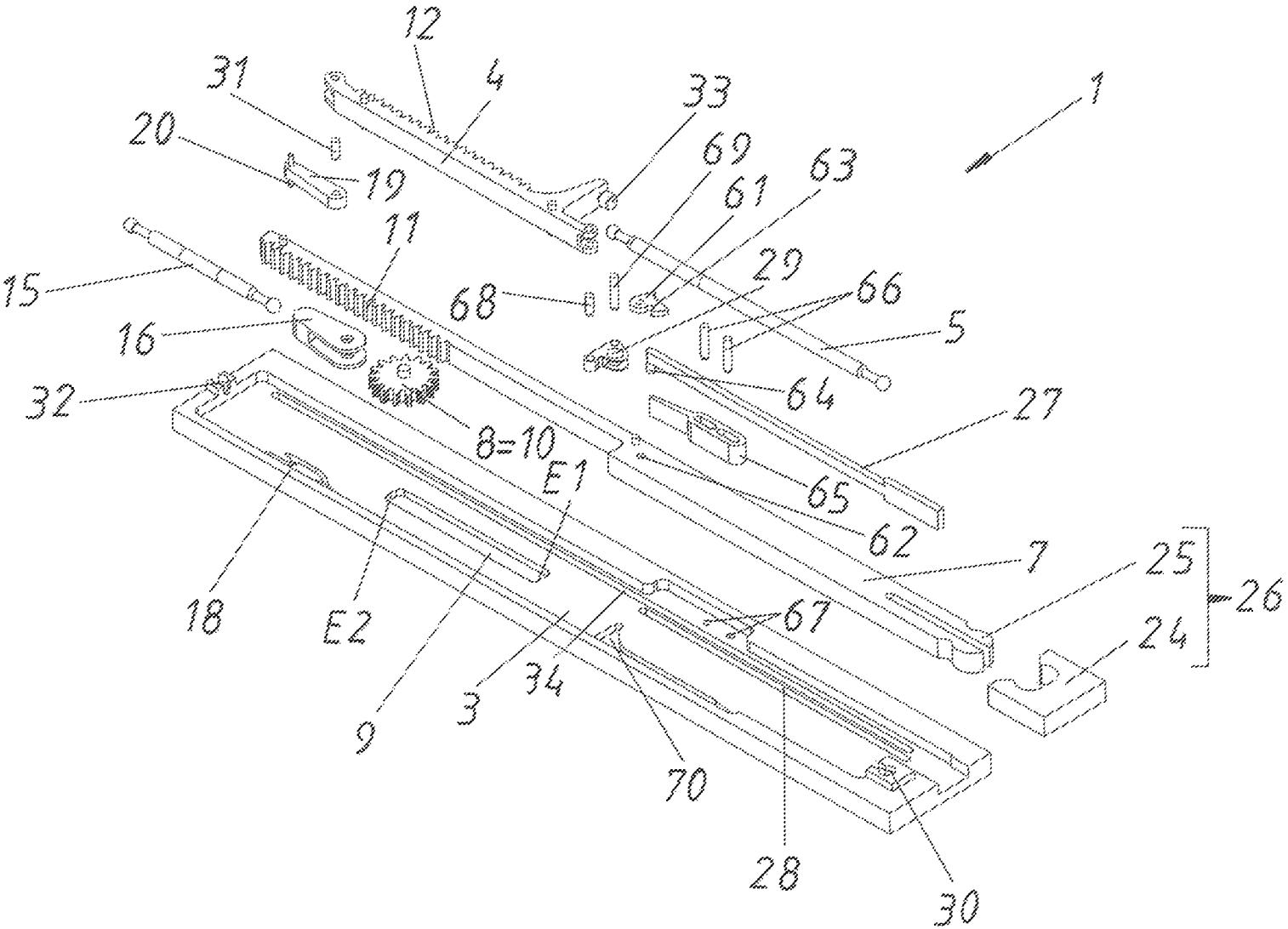
FIG. 2 shows this ejection device in an exploded view.

FIG. 2 shows an exploded view of the ejection device 1. The ejection device 1 comprises the carrier 3 as a base portion. Together with a cover (not shown), the carrier 3 can form a housing for all of the components of the ejection device 1. A sliding guide track 18 for the ejection element 4 is formed in the carrier 3. The control lever 19 is rotatably supported on the ejection element by the control lever rotary bearing 31. The control pin 20, in turn, is arranged on this control lever 19. The control pin 20 engages the cardioid-shaped sliding guide track 18. Additionally, a guide track 34 for the tensioning element 7 is formed in the carrier 3. The coupling piece 25 is arranged on the front end of this tensioning element 7. The coupling piece 25 together with the coupling counter piece 24 forms the coupling device 26. Additionally, a coupling and decoupling element 27 together with the coupling force storage member 40 is provided for the coupling and decoupling. This coupling force storage member 40, which is formed as an approximately V-shaped arranged tension spring, is not illustrated in FIG. 2. However, it can be seen starting from FIG. 4. The guide track 28 for the coupling and decoupling element 27 is formed in the carrier 3. Further, a latch 61 for the coupling and decoupling element 27 is provided. The latch 61 is rotatably supported in the bearing 62 and comprises a receiving recess 63 for the projection 64 formed on the coupling and decoupling element 27. The latch abutment 65 is held in the recesses 67 of the carrier 3 by the bolts 66.

The ejection force storage member 5 on the one hand is connected to the ejection element 4 by the spring base 29, and on the other hand engages the spring base 30 formed in the carrier 3. The spring base 29 is hingedly connected to the ejection element 4 by the bolt 68. Moreover, a further control bolt 69 is held in the spring base 29, the control bolt 69 allows a targeted guidance of the spring base 29 in the region 70 of the sliding guide track 18. A gear rack 12 is also formed on the ejection element 4. The tensioning element 7 is movably coupled with the movement transmission element 8. In particular, this movement transmission element 8 is formed as a gear wheel 10 which meshes with the gear rack 11 of the tensioning element 7 and with the gear rack 12 of the ejection element 4. The movement transmission element 8 on the one hand is displaceably supported in the guide track 9 formed in the carrier 3 and on the other hand is rotatably supported in the slider 16. The guide track 9 comprises two end abutments E1 and E2. The slider 16, in turn, is part of the retrieving device 13 for the tensioning element 7. Especially, the retrieving force storage member 15 engages this slider 16. In addition, this retrieving force storage member 15 is fixed on its other end to the spring base 32 formed in the carrier 3.

Figure 3:
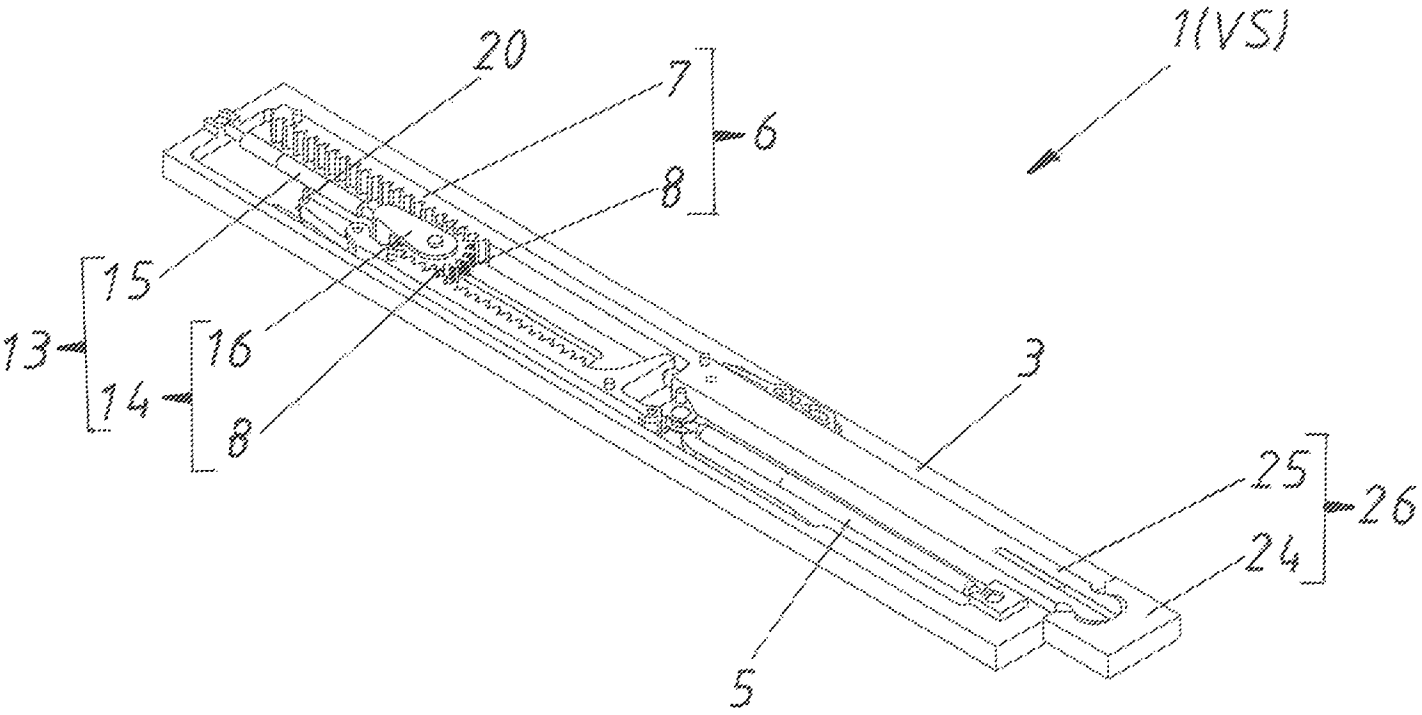
FIG. 3 is a perspective view of the assembled ejection device.

FIG. 3 shows the ejection device 1 in an assembled state. In this case, the coupling piece 25 is in a loose connection with the coupling counter piece 24. Moreover, it can be seen that the tensioning element 7 together with the movement transmission element 8 forms the tensioning device 6. Additionally, this movement transmission element 8 together with the slider 16 simultaneously forms the retrieving element 14. This retrieving element 14, in turn, together with the retrieving force storage member 15 forms the retrieving device 13. In this FIG. 3 the retrieving force storage member 15—in this formed as a spring, preferably as a tension spring—is in a relaxed position. In contrast, the ejection force storage member 5—which is as well formed as a spring, preferably as a tension spring—is in a tensioned position. The control pin 20 of the locking device 17 is located in the latch recess of the cardioid-shaped sliding guide track 18, whereby the whole ejection device 1 is in the locking position VS.

The FIGS. 4 to 12 each show on the left side a top view onto the ejection device 1 in different positions. The same top view is shown on each right side, wherein the not-visible components located beneath are indicated by dashed lines.

Figure 4:
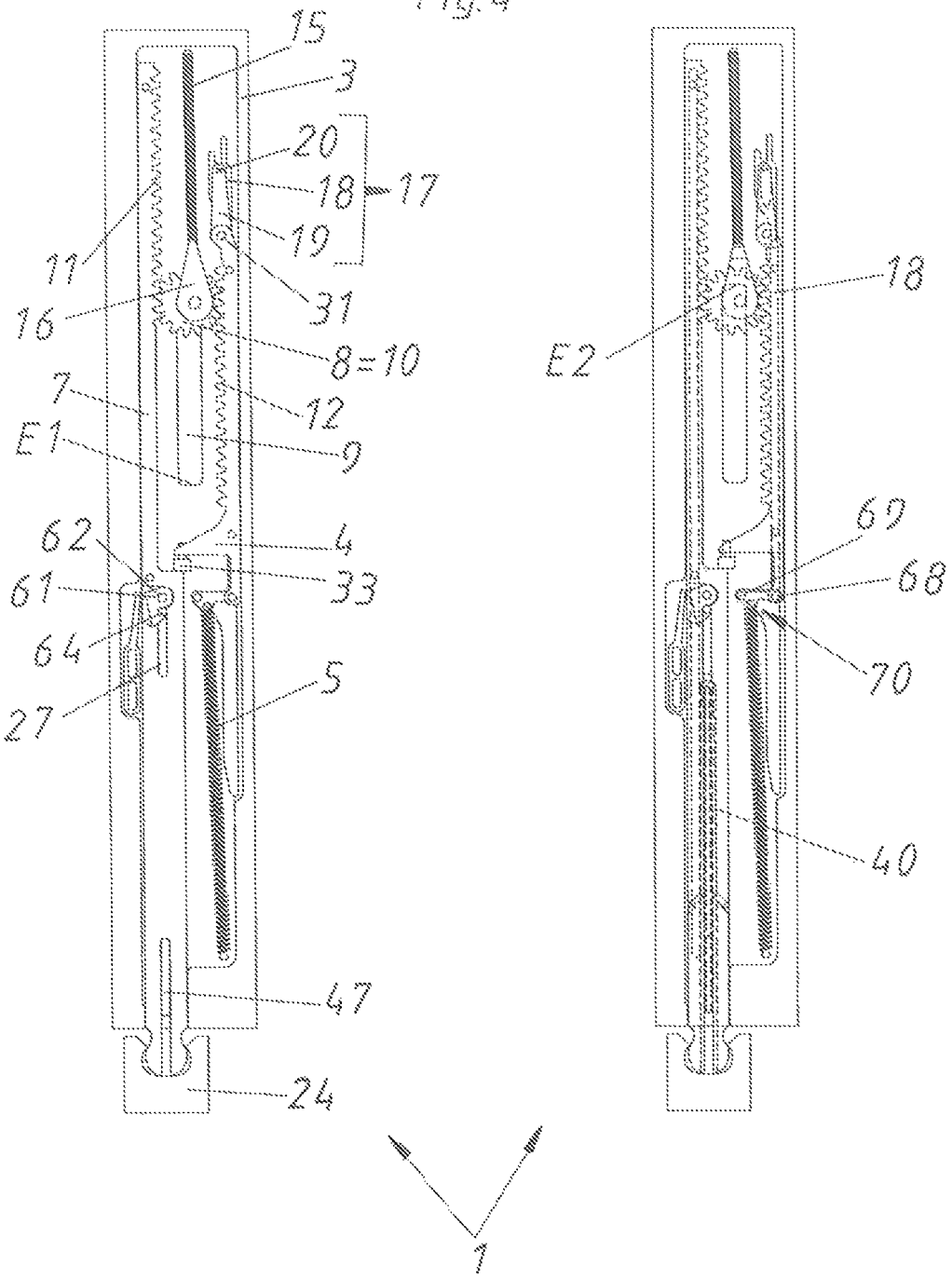
FIGS. 4 to 12 is a top view of the movement sequence of the ejection device during the ejection, tensioning and retrieving.

In FIG. 4 the ejection device 1 is in the same position as in FIG. 3, that is to say in the locking position VS. Additionally, the movable furniture part 2 (not shown here) is in the closed position SS. This closed position SS is represented by the coupling counter piece 24, which is indeed attached to the movable furniture part 2. In this locking position VS, the tensioning element 7 abuts the ejection element 4 by the buffering element 33. The control pin 20 arranged on the control lever 19 is located in the latch recess of the cardioid-shaped sliding guide track 18 of the locking device 17. The ejection force storage member 5 is tensioned, whereas the retrieving force storage member 15 is relaxed. The latch 61 encompasses the projection 64 via its receiving recess 63, whereby the coupling and decoupling element 27 with its tip 47 is located in a retracted position from the head region of the coupling piece 25. The coupling force storage member 40 is tensioned in this position. The coupling force storage member 40 is held in the tensioning element 7 with its two ends and abuts the coupling and decoupling element 27 in a central region. The coupling device 26 is in the coupling position EK, in which the coupling piece 25 and the coupling counter piece 24 are loosely connected to teach other.

Figure 5:
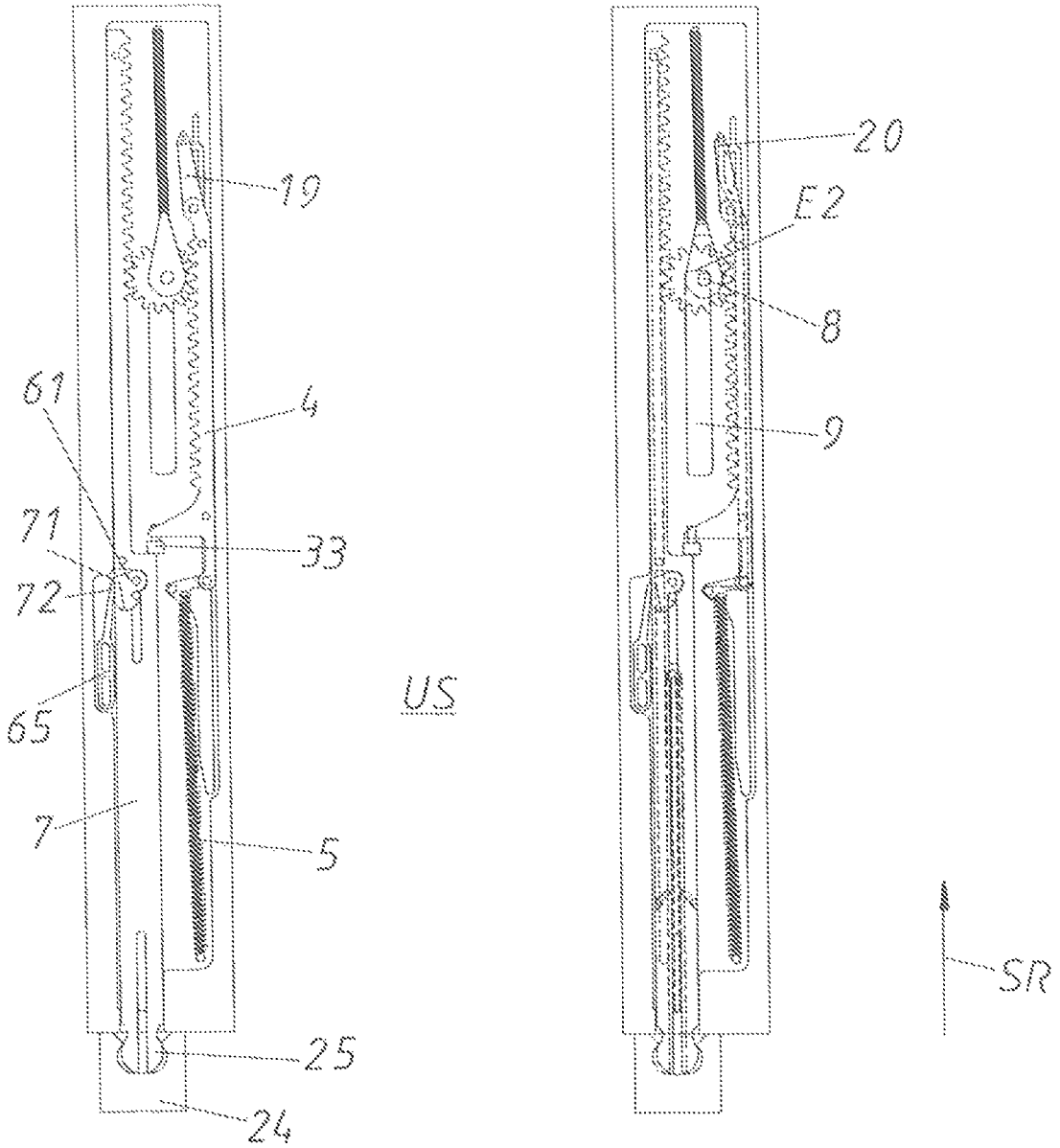
Figure 6:
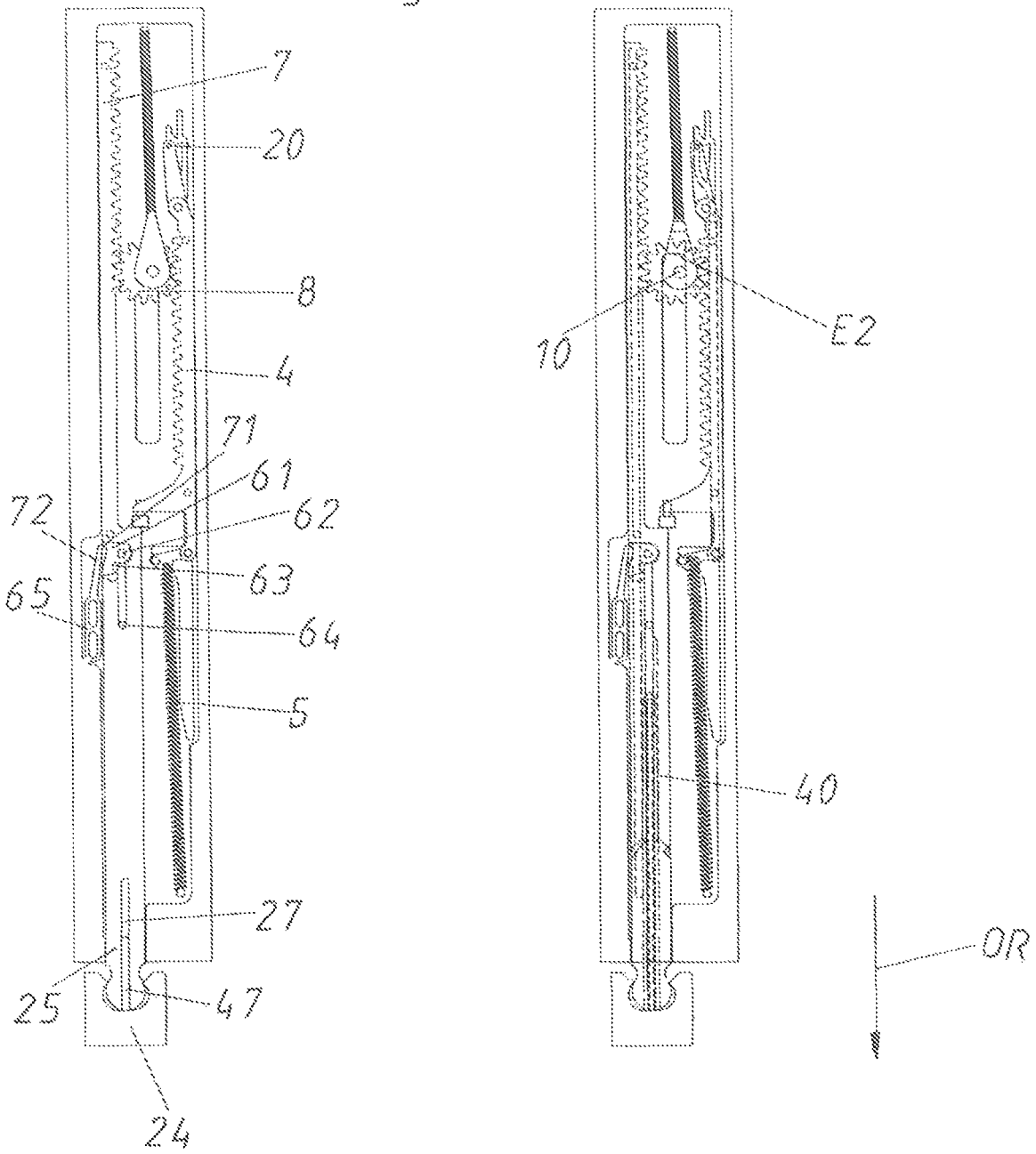

When pressing onto the movable furniture part 2 in the closing direction SR starting form this closed position SS according to FIG. 4, the ejection device 1 arrives in the over-pressing position US according to FIG. 5. By this over-pressing movement, the tensioning element 7 is moved in the closing direction SR via the coupling counter piece 24 and the coupling piece 25. Via the buffering element 23, the ejection element 4 is also moved against the force of the ejection force storage member 5 in the closing direction SR, whereby the control lever 19 and especially its control pin 20 is removed from the latch recess of the cardioid-shaped sliding guide track 18 and reaches the ejection section of the sliding guide track 18 by a corresponding deflection slope. As a consequence, the ejection element 4 is no longer locked in the carrier 3 via the locking device 17 but is in an unlocking state ES. On the right side, it can be seen that also the movement transmission element 8 has been moved to the end abutment E2 of the guide track 9 by this over-pressing movement. Also, the latch 61 has been moved relative to the latch abutment 65 by this over-pressing movement, wherein the projection 71 of the latch 61 has passed the—in the case of a lateral force actuating direction—resilient end 72 of the latch abutment 65.

As soon as a user releases the movable furniture part 2 starting from this position according to FIG. 5, the ejection force storage member 5 can relax. As a consequence, the ejection device 1 initially reaches the position according to FIG. 6, which corresponds to a slightly opened open position OS of the movable furniture part 2. It can be seen that the control pin 20 in its unlocking state ES has already moved a bit in the opening direction OR through the ejection section of the sliding guide track. As the ejection force storage member 5 pulls the ejection element 4, this ejection element 4 is also moved in the opening direction OR relative to the carrier 3. As additionally the ejection element 4 abuts the tensioning element 7 via the buffering element 33, this tensioning element 7 is also moved in the opening direction OR. Furthermore, as the movement transmission element 8 is movably supported in the guide track 9, the ejection element 4, the movement transmission element 8 and the tensioning element 7 are commonly moved relative to the carrier 3 over this first part of the ejection path A. Also the latch 61 arranged on the tensioning element 7 is carried by this movement of the tensioning element 7 in the opening direction OR, whereby the projection 71 abuts the—in the case of a frontal force actuating direction—rigid end 72 of the latch abutment 65. As a consequence, a clockwise rotational movement of the latch 61 about the bearing 62 is initiated. The projection 64, thus, is no longer held in the receiving recess 63 of the latch 61. Thereby, the coupling force storage member 40 has already relaxed according to FIG. 6 and the coupling and decoupling element 27 together with its tip 47 has moved into the head region of the coupling piece 25. As a consequence, the projections of the head region distanced from each other cannot be bent towards each other and the coupling position K of the coupling device 26 in the form of a positive-locking engagement between the coupling piece 25 and the coupling counter piece 24 is reached.

Figure 7:
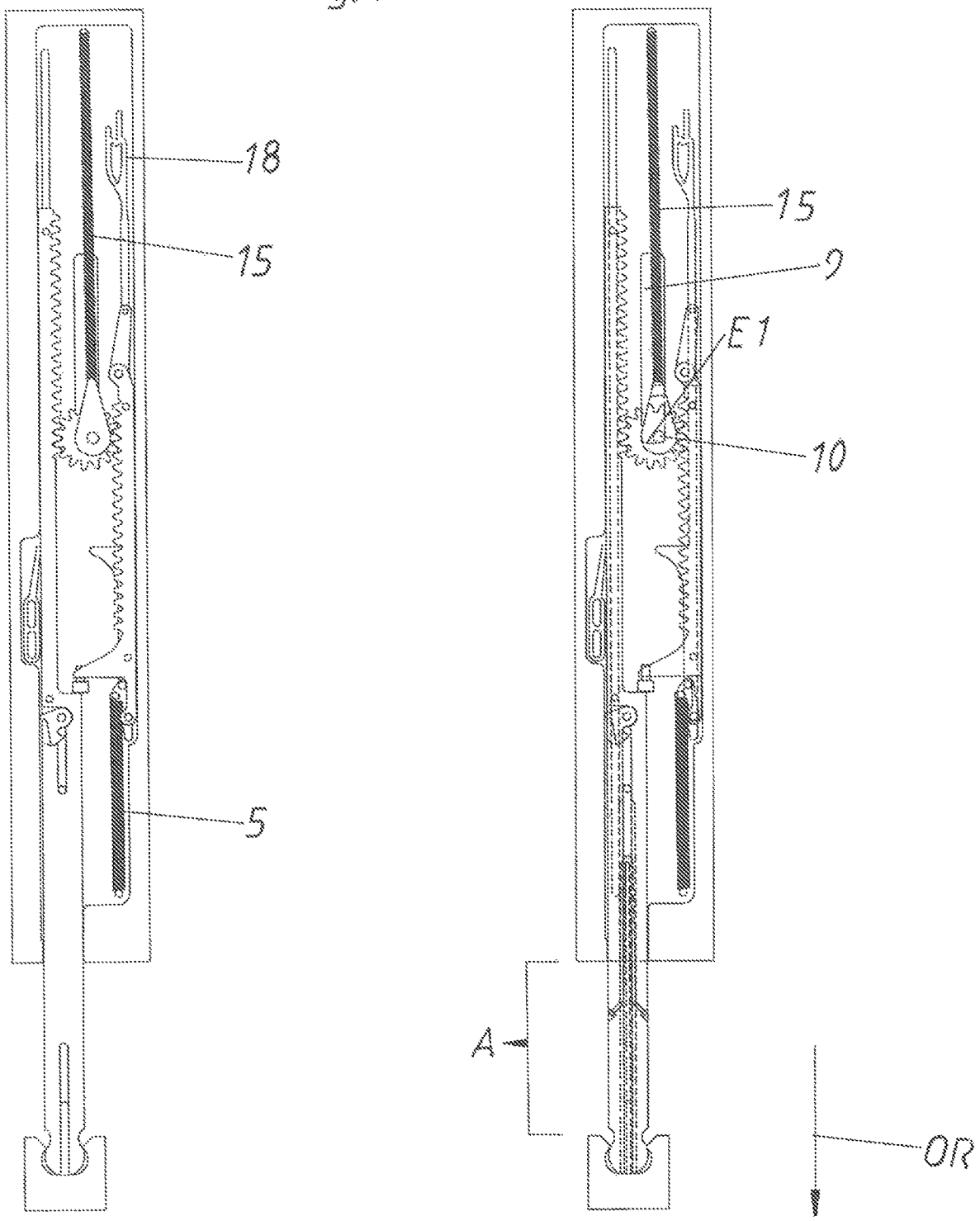

In FIG. 7 the ejection device 1 has already travelled the ejection path A. The ejection force storage member 5 has relaxed. The movement transmission element 8 in the form of a gear wheel 10 abuts the end abutment E1 of the guide track 9. Also, the retrieving force storage member 15 has been relaxed with this ejection movement of the ejection element 4 and the co-movement of the movement transmission element 8.

Figure 8:
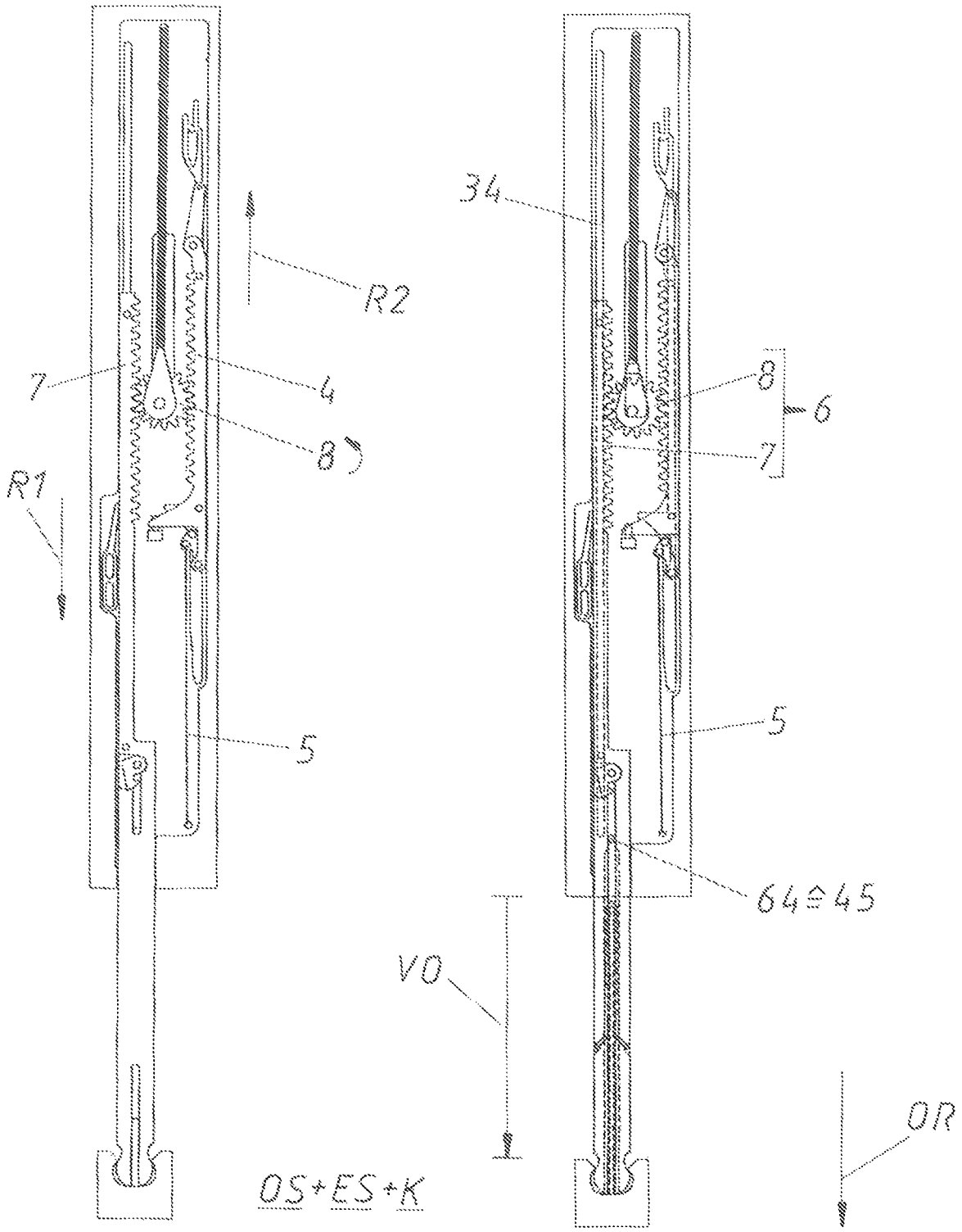

As starting from the open position OS according to FIG. 7, the movement transmission element 8 can no longer be co-moved in the opening direction OR with the tensioning element 7 because the movement transmission element 8 abuts the end abutment E1 of the guide track 9, a relative movement between the tensioning element 8 and the movement transmission element 8 takes place by further pulling the movable furniture part 2 in the opening direction OR according to FIG. 8. Concretely, the tensioning element 8 is further moved in the direction R1, whereby the movement transmission element 8 rotates counterclockwise. Due to this rotation of the movement transmission element 8, the ejection element 4 is moved in the opposite direction R2 by the gear rack 12. As a consequence, also the ejection force storage member 5 is again tensioned. Thus, the tensioning element 7 together with the movement transmission element 8 forms the tensioning device 6 for the ejection force storage member 5. This ejection force storage member 5 is (partly) illustrated as a continuous line in a mere schematic manner in FIG. 8 and also in the FIGS. 9, 10 and 13 in order to demonstrate the length. In FIG. 8, the projection 64, which simultaneously forms an abutment 45 for the coupling and decoupling element 27, abuts the carrier 3. Thus, the predetermined opening path VO is reached. If now further pulling the movable furniture part 2 in the opening direction OR, the coupling and decoupling element 27 cannot move together with the tensioning element 7 forming the coupling piece 25.

Figure 9:
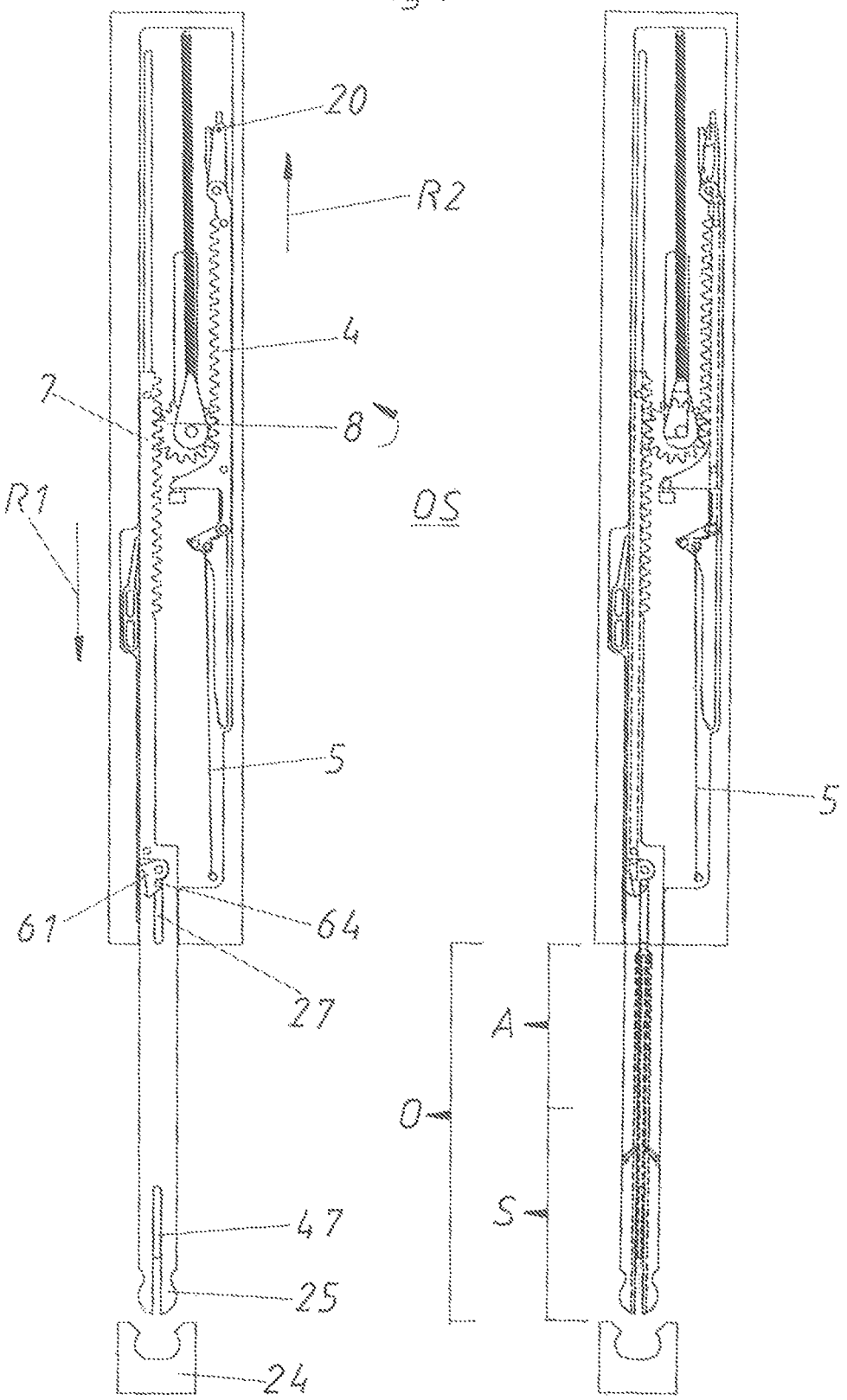

According to FIG. 9, this tensioning movement via the tensioning element 7 has continued so far that tip 47 of the coupling and decoupling element 27 has been completely removed from the head region of the coupling piece 25, whereby the coupling device 26 is decoupled (decoupling position EK) so that the coupling counter piece 24 and, thus, the movable furniture part 2 is no longer coupled to the ejection device 1. The projection 64 is again held in the receiving recess 63 of the latch 61. The coupling force storage member 40 is again loaded. By this tensioning movement also the control lever 20 has again moved in a position of the sliding guide track 20 located behind the latch recess. In FIG. 9 the whole opening path O has been travelled by the ejection device 1. The opening path O consists of the ejection path A and the subsequent tensioning path S. According to FIG. 9 the movable furniture part 2 can now be freely moved.

Figure 10:
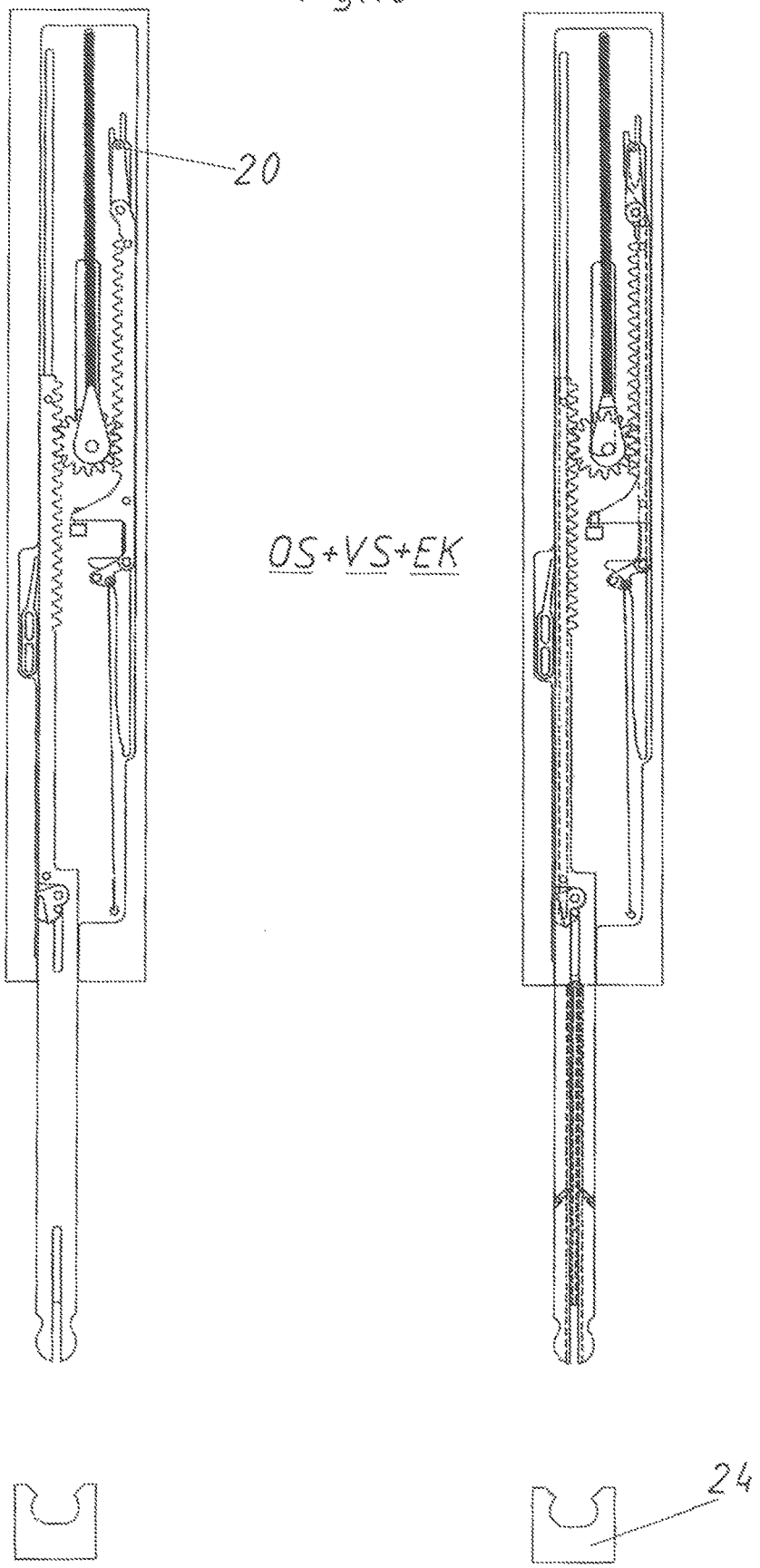

As now no more forces are acting from the movable furniture part 2 onto the ejection device 1 (i. e. the tensioning element 7 and thus the ejection element 4 is no longer actively pulled), the ejection force storage member 5 can again shortly and slightly relax until the control pin 20 latches in the latch recess of the cardioid-shaped sliding guide track 18 according to FIG. 10. The locking position VS of the locking device 17 and the ejection element 4 respectively, thus, is reached.

Figure 11:
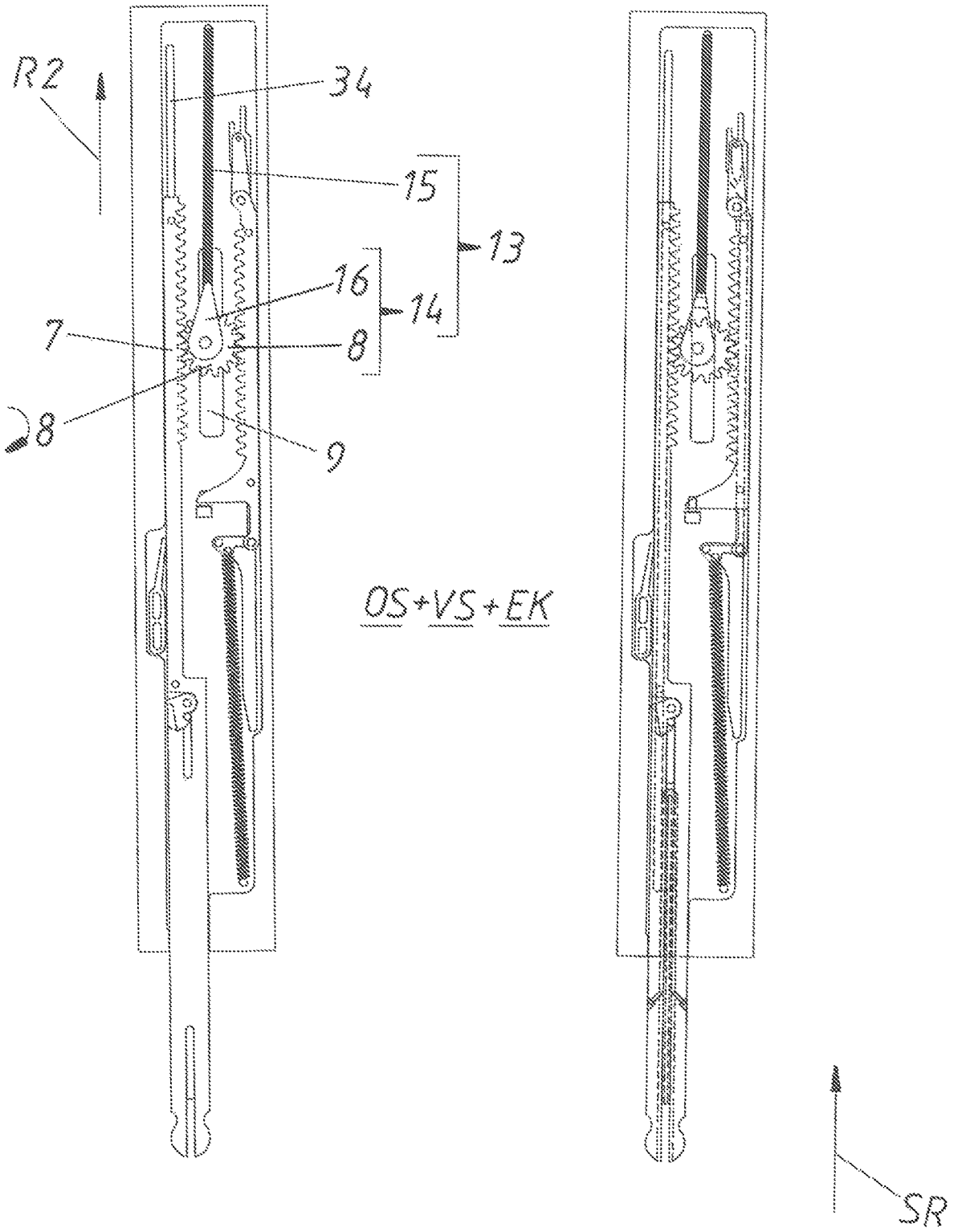

Thereafter, the retrieving force storage member 15 starts to relax according to FIG. 11. As this retrieving force storage member 15 pulls the slider 16 of the retrieving element 14, and as at the same time the ejection element 4, however, is fixed because of the locking of the locking device 17, the movement transmission element 8 in the form of the gear wheel 10 on the one hand starts being displaced in the guide track 9 in the direction R2 and on the other hand starts to rotate clockwise in the slider 16. The tensioning element 7 is also being moved—in this case twice as fast as the movement transmission element 8—in the direction R2 by this rotation of the movement transmission element 8. The movable furniture part 2 is still in the open position OS, whereas the ejection device 1 is already in the locking position VS of the locking device 17.

Figure 12:
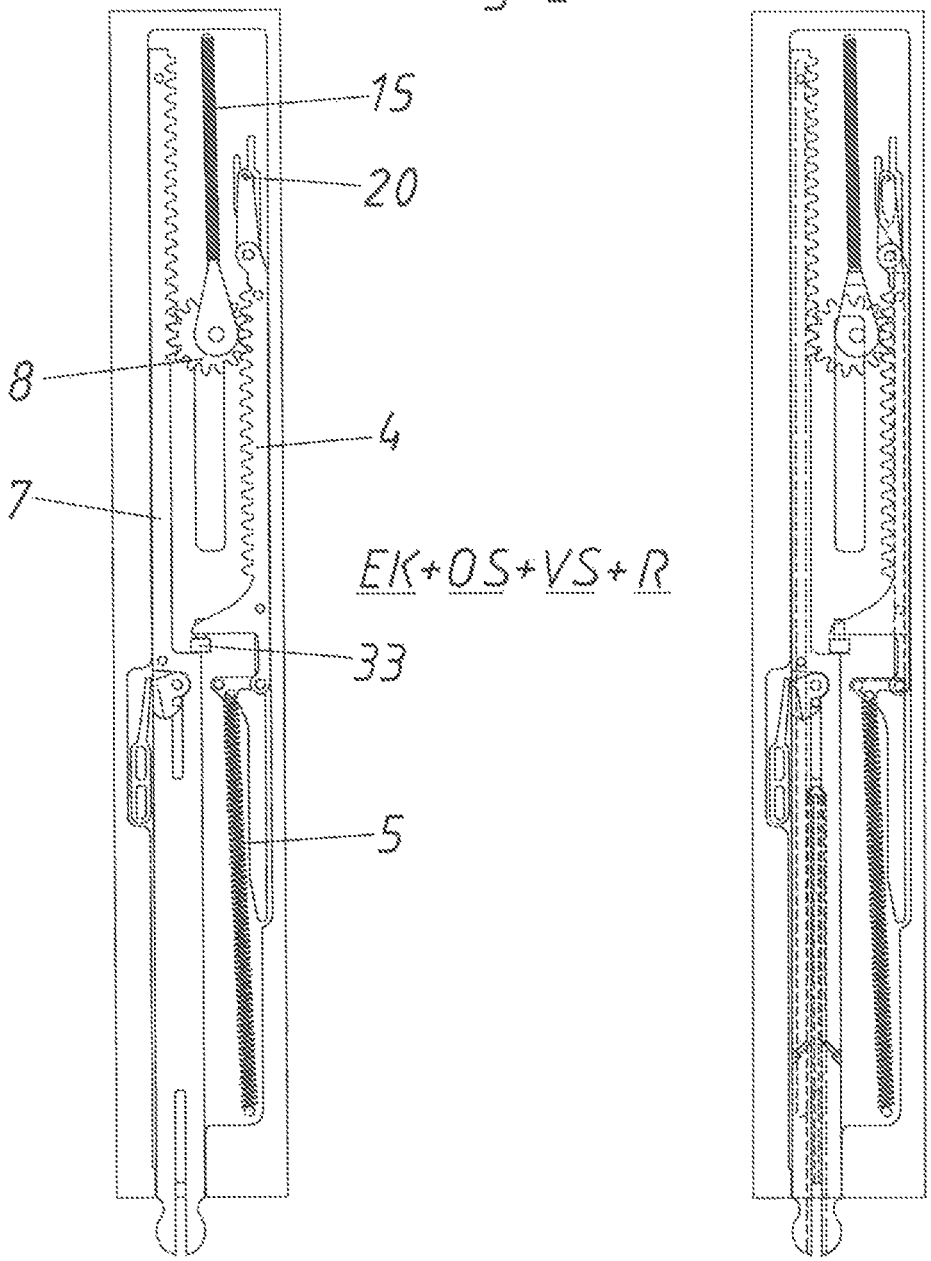

In FIG. 12, the retrieving force storage member 15 has fully relaxed, whereby the tensioning element 7 again abuts the ejection element 4. In this case, the impact of the tensioning element 7 on the ejection element 4 is damped by the buffering element 33. The tensioning element 7 is thereby being moved into the retrieved position R by the retrieving device 13. In contrast to FIG. 4, in FIG. 49 the movable furniture part 2 is still in the open position OS. If the movable furniture part 2 is manually closed again starting from this open position OS, the coupling counter piece 24 again arrives in a loose connection to the coupling piece 25 in the last closing section, whereby the position according to FIG. 4 would again be reached.

Figure 13:
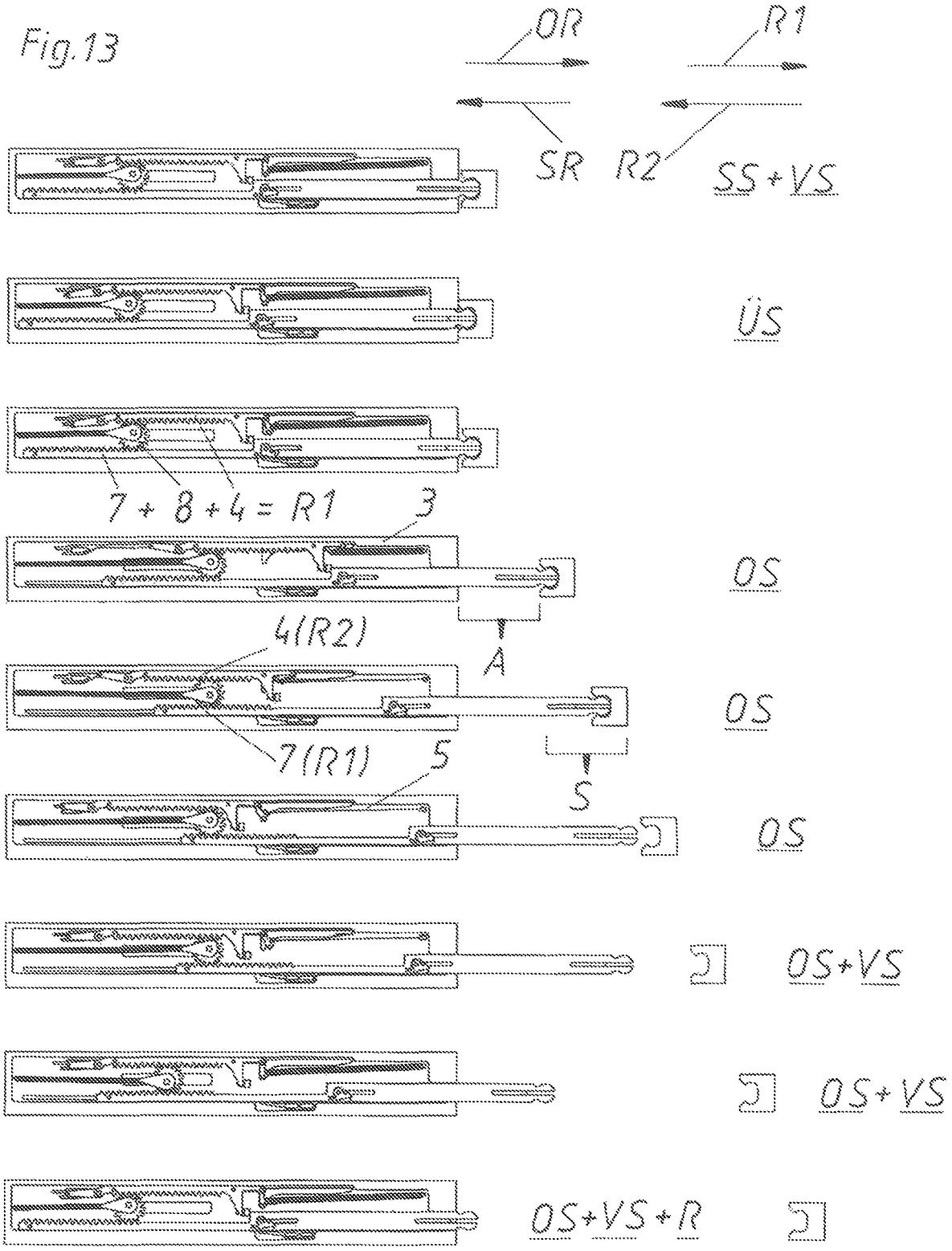
FIG. 13 shows in an overview the movement sequence of the ejection device on one side.

In FIG. 13 the individual positions according to the FIGS. 4 to 12 are once again illustrated overseeable in a sequence. In a comparison of the third image with the fourth image of this FIG. 13, it can be seen how according to the invention the ejection element 4, the movement transmission element 8 and the tensioning element 8 are commonly movable over the ejection path A relative to the carrier 3.

The invention claimed is:

1. An ejection device for moving a movable furniture part, the ejection device comprising:

a carrier, an ejection element for ejecting the movable furniture part from a closed position into an open position along an ejection path, an ejection force storage member force-actuating the ejection element in the opening direction of the movable furniture part, the ejection force storage member engaging both the carrier and the ejection element, and a tensioning device for tensioning the ejection force storage member, the tensioning device including a tensioning element to be coupled to the movable furniture part, and a movement transmission element between the tensioning element and the ejection element, the tensioning element and the ejection element being configured to be moved in opposite directions in a coupled manner by the movement transmission element when the ejection force storage member is tensioned, the ejection element, the movement transmission element, and the tensioning element being moveable together relative to the carrier at least over a first part of the ejection path, a retrieving device for moving the tensioning element in a retrieved position, the retrieving device including a retrieving element configured to be coupled to the tensioning element, and a retrieving force storage member force-actuating the retrieving element, and wherein the retrieving element is integrally formed with the movement transmission element.

2. The ejection device according to claim 1, wherein the ejection element, the movement transmission element, and the tensioning element are moveable together relative to the carrier over the whole ejection path.

3. The ejection device according to claim 1, wherein the ejection element, the movement transmission element and the tensioning element are displaceable together along a guide track formed in the carrier and comprising two end abutments.

4. The ejection device according to claim 3, wherein the movement transmission element abuts an end abutment of the guide track when the ejection force storage member is tensioned.

5. The ejection device according to claim 1, wherein the movement transmission element is formed as a gear wheel.

6. The ejection device according to claim 1, wherein the tensioning element and the ejection element each comprise a gear rack.

7. The ejection device according to claim 5, wherein, when the ejection force storage member is tensioned, the gear rack of the tensioning element and the gear rack of the ejection element mesh with the movement transmission element formed as a gear wheel and are movable in opposite directions in a coupled manner by the movement transmission element.

8. The ejection device according to claim 1, wherein the retrieving element comprises a slider and the movement transmission element formed as a gear wheel and rotatably supported in the slider.

9. An ejection device for moving a movable furniture part, the ejection device comprising:

a carrier, an ejection element for ejecting the movable furniture part from a closed position into an open position along an ejection path, an ejection force storage member force-actuating the ejection element in the opening direction of the movable furniture part, the ejection force storage member engaging both the carrier and the ejection element, and a tensioning device for tensioning the ejection force storage member, the tensioning device including a tensioning element to be coupled to the movable furniture part, and a movement transmission element between the tensioning element and the ejection element, the tensioning element and the ejection element being configured to be moved in opposite directions in a coupled manner by the movement transmission element when the ejection force storage member is tensioned, the ejection element, the movement transmission element, and the tensioning element being moveable together relative to the carrier at least over a first part of the ejection path, a retrieving device for moving the tensioning element in a retrieved position, the retrieving device including a retrieving element configured to be coupled to the tensioning element, and a retrieving force storage member force-actuating the retrieving element, and wherein the retrieving element is displaceably supported in a limited manner in a guide track comprising two end abutments and formed in the carrier.

10. The ejection device according to claim 1, wherein the ejection force storage member is configured to be tensioned by the tensioning device when pulling the movable furniture part in the opening direction.

11. The ejection device according to claim 1, further comprising a locking device for locking the ejection element in a locking position, the locking device configured to be unlocked by over-pressing the movable furniture part into an over-pressed position located behind the closed position.

12. The ejection device according to claim 11, wherein the locking device includes a sliding guide track formed in the carrier, a control lever movably supported on the ejection element, and a control pin arranged on the control lever and engaging the sliding guide track.

13. An item of furniture comprising:

a furniture carcass, a movable furniture part, and ejection device according to claim 1 for moving the movable furniture part.

14. The item of furniture according to claim 13, wherein the movable furniture part is a furniture door, the furniture door being pivotally supported on the furniture carcass by two hinges, and the ejection device being arranged at a position distanced from the two hinges.

15. The item of furniture according to claim 14, wherein the ejection device is arranged in a region of the furniture carcass opposite to the two hinges.

16. The ejection device according to claim 1, wherein the carrier is formed as a housing.

17. The ejection device according to claim 1, wherein the movement transmission element of the tensioning device is rotatable.

18. The ejection device according to claim 2, wherein the ejection element, the movement transmission element, and the tensioning element are moveable together relative to the carrier for the same distance and without any movement relative to each other.

19. The ejection device according to claim 3, wherein the ejection element, the movement transmission element, and the tensioning element are linearly displaceable together along the guide track.

20. The ejection device according to claim 7, wherein, when the ejection force storage member is tensioned, the gear rack of the tensioning element and the gear rack of the ejection element are movable in a 1:1-transmission ratio in opposite directions in the coupled manner by the movement transmission element.

21. The ejection device according to claim 10, wherein the ejection force storage member is configured to be tensioned by the tensioning device when pulling the movable furniture part in the opening direction along a tensioning path following the ejection path.

22. The ejection device according to claim 12, wherein the sliding guide track formed in the carrier is cardioid-shaped, and the control lever is rotatably supported on the ejection element.

* * * * *